US007004808B1

(12) United States Patent
Nelson et al.

(10) Patent No.: US 7,004,808 B1
(45) Date of Patent: Feb. 28, 2006

(54) ADJUSTABLE COMBINATION FLOTATION DEVICE

(76) Inventors: Douglas R. Nelson, 444 N. El Camino Real, No. 86, Encinitas, CA (US) 92024; Scott H. M. Daniels, 12765 Spikerush Cir., Boca Raton, FL (US) 33428

( * ) Notice: Subject to any disclaimer, the term of this patent is extended or adjusted under 35 U.S.C. 154(b) by 0 days.

(21) Appl. No.: 10/926,939

(22) Filed: Aug. 26, 2004

(51) Int. Cl.
*B63C 9/08* (2006.01)

(52) U.S. Cl. ..... 441/106

(58) Field of Classification Search ..... 441/88, 441/89, 98, 106
See application file for complete search history.

(56) References Cited

U.S. PATENT DOCUMENTS

| | | | | |
|---|---|---|---|---|
| 2,629,118 | A | 2/1953 | Frieder et al. | |
| 3,199,128 | A | 8/1965 | Nojd | |
| 3,266,070 | A | 8/1966 | O'Link | |
| 3,931,657 | A | 1/1976 | Jones | |
| 4,167,051 | A | 9/1979 | Galecke | |
| 4,864,656 | A | 9/1989 | Nesse | |
| 5,037,341 | A | 8/1991 | Howard | |
| 5,603,648 | A * | 2/1997 | Kea | 441/106 |
| 6,447,353 | B1 | 9/2002 | Henry | |
| 6,475,047 | B1 | 11/2002 | Cynamon | |

* cited by examiner

*Primary Examiner*—Lars A. Olson
(74) *Attorney, Agent, or Firm*—Malloy & Malloy, P.A.

(57) ABSTRACT

An adjustable combination flotation device comprises a support assembly structured to be disposed in an operative position about a user. The flotation device also includes a flotation assembly disposed in a supported configuration with the support assembly, the flotation assembly having at least one active flotation member and at least one passive flotation member. The adjustable combination flotation device also includes an attachment assembly having at least one primary attachment mechanism structured to securely attach the support assembly to a user in a fixed configuration so as to substantially limit displacement of the device relative to the user while the support assembly is disposed in the operative position. The adjustable combination flotation device may also include a protective member disposed substantially within the support assembly and structured to inhibit penetration by an offensive object, such as a bullet, shrapnel, or other projectile.

28 Claims, 4 Drawing Sheets

ADJUSTABLE COMBINATION FLOTATION DEVICE

BACKGROUND OF THE INVENTION

1. Field of the Invention

The present invention is directed to an adjustable combination flotation device comprising a support assembly having an active flotation member and a passive flotation member disposed in an operative engagement with one another so as to substantially limit displacement of the flotation members within the support assembly. Moreover, the flotation device further includes structure to securely attach the support assembly about a user along an inner surface in a manner that restricts displacement of the device relative to the user, such as riding-up on the user upon entry into the water.

2. Description of the Related Art

A variety of different styles and types of flotation devices commonly known as "life jackets" and "life vests" are available for use in a variety of different applications. In the simplest form, such a device may consist of a buoyant doughnut shaped device which a second party may toss out to a first party who is in distress in a body of water. To be effective, however, such a device requires the second party to be available and aware of the first party, and that the second party is able to toss the device within reach of the first party who is in distress.

The drawbacks to this type of device are obvious, and as a result, a number of devices have been developed which do not require the assistance of a second party to be effective. Many of these devices take the form of a coat or vest, as noted above, and include one or more buoyant components such that the device has some degree of buoyancy when placed in a body of water. Such devices are structured for a user to wear, much as a regular coat or a vest, and in some cases, the user may be required to wear the device at all times while on board a vessel, such that in the event the user finds himself or herself in a body of water, the device is readily available to assist them.

While such devices in and of themselves are generally effective, when used as designed, a common problem exists in that many people simply fail to properly don these devices, or to don them at all. The reasons for this phenomenon are mainly twofold, first, these devices are generally bulky and uncomfortable, making the user hot and uncomfortable while wearing the device, therefore, many people who should otherwise be wearing such a device, for example, recreational boaters, simply do not. In addition, these devices typically restrict or at least limit the mobility of the person wearing them and as such, the crew members of many commercial vessels who are carrying out their duties to operate such a vessel may elect not to wear the devices as directed, in order to permit them to fulfill their tasks more efficiently.

Attempts to make flotation devices less bulky and more comfortable led to inflatable flotation devices, however, many of these devices require the active participation of the wearer to inflate the device before it is effective. As such, composite devices having both an inflatable and a non-inflatable portion have been also developed in attempts to address comfort while assuring that the non-inflatable portion has at least some degree of buoyancy in the event the wearer is unable to inflate the device. One problem with such composite devices, however, is that the inflatable and non-inflatable portions have a tendency to become displaced and/or entangled with one another thereby reducing the effectiveness of the device, in some cases, significantly.

Another drawback of known flotation devices is a "one size fits all" approach by manufacturers of such devices, which often leads to further discomfort, and the resultant reluctance to wear the device as indicated above. A further problem with this "one size fits all" approach is that not all people will have the same buoyancy requirements and, as such, the factory furnished device may not provide a buoyancy level which is suitable for every user's particular needs.

One further problem common to all currently known "life-jackets" or "life-vests" is their tendency to become displaced relative to the user upon entry to the water. This is due to the ineffectiveness of the mechanisms utilized to secure the device to the user. With some devices displacement may occur with such force that the user is injured. For example, certain fixed flotation devices utilized by the military are known to "ride-up" on personnel upon entry into the water, which may originate from an elevation of several stories above the water when exiting a military vessel in distress, the force of entry being such that the stiff foam panel of the device strikes the back of the wearer's head or neck with sufficient force to knock the user unconscious, thereby severely impairing their ability to escape to safety.

Therefore, it would be beneficial to provide a flotation device that is securely attached to a user in a fixed manner to minimize the displacement of the device relative to the user, in particular, upon entry onto a body of water. In addition, it would be preferable for the passive and active flotation members of such a device to be cooperatively structured so as to minimize the displacement of the flotation members within the device to assure maximum buoyancy is provided by the device. It would also be beneficial to provide a flotation device in which the degree of buoyancy may be readily adjusted, such as by the addition or removal of additional buoyancy members until the desired buoyancy level is attained. A further advantage would be to permit the selective addition of a protective layer of material to the device, such as that used in bullet proof or bullet resistant garments.

SUMMARY OF THE INVENTION

The present invention is directed to an adjustable combination flotation device having a support assembly structured to be disposed in an operative position about a user. The inventive device also includes a flotation assembly disposed in a supported configuration with the support assembly. In addition, the adjustable combination flotation device of the present invention includes an attachment assembly having at least one primary attachment mechanism. The primary attachment mechanism is structured to securely attach the support assembly about the user in a fixed configuration so as to substantially limit the displacement of the adjustable combination flotation device relative to the user when disposed in the operative position.

The support assembly of the present invention comprises an inner panel and an outer panel structured and cooperatively associating to at least partially define an interior portion and an exterior portion. In addition, the support assembly includes an access mechanism structured to be disposable between an open position and a closed position. The access mechanism is further structured such that when it is disposed in the open position, it allows access to the interior portion of the support assembly to permit adjustment and/or repair of the flotation assembly therein.

As noted above, the adjustable combination flotation device of the present invention includes a flotation assembly disposed in a supported configuration with the support assembly and, in at least one embodiment, the flotation assembly is disposed substantially within the interior portion of the support assembly. The flotation assembly includes at least one active flotation member and at least one passive flotation member disposed in an operative engagement with one another. The flotation assembly may further include a plurality of active flotation members and a plurality of passive flotation members disposed in operative engagement with one another. In one embodiment, the active flotation member comprises an inflatable bladder while the passive flotation member comprises a closed cell foam construction. In this embodiment, the passive flotation member is disposed in an inner portion of the inflatable bladder thereby at least partially defining the operative engagement and minimizing displacement of the flotation members within the interior portion of the support assembly.

The flotation assembly of the present invention further includes an actuation device disposed in a communicative relation with the active flotation member, the actuation device being structured to inflate the active flotation member. In at least one embodiment, the flotation assembly comprises a plurality of active flotation members. In this embodiment, the plurality of active flotation members may be disposed in a fluid communicating arrangement with one another such that each of the active flotation members can be inflated by a common actuation device.

Also as noted above, the present invention includes an attachment assembly structured to securely attach the support assembly about the user in a fixed configuration. The attachment assembly includes at least one primary attachment mechanism which is securely interconnected to at least one portion of the inner panel of the support assembly and structured to facilitate securely attaching the support assembly about the user in the fixed configuration. The fixed configuration is at least partially defined by securely attaching the support assembly about the user along an inner surface so as to substantially limit displacement of the flotation device relative to the user when the support assembly is disposed in the operative position about the user.

The attachment assembly of the present invention may also include an auxiliary attachment mechanism securely interconnected to the support assembly. In at least one further embodiment, the auxiliary attachment mechanism is also securely interconnected to at least one portion of the inner panel of the support assembly. The auxiliary attachment mechanism is structured to further facilitate secure attachment of the support assembly about the user in the fixed configuration.

Additionally, the attachment assembly of the present invention may further comprise a sealing mechanism securely interconnected to the support assembly and structured to further facilitate secure attachment of the support assembly about the user in the fixed configuration so as to substantially and further limit displacement of the adjustable combination flotation device relative to the user while the support assembly is disposed in an operative position.

These and other objects, features and advantages of the present invention will become apparent when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
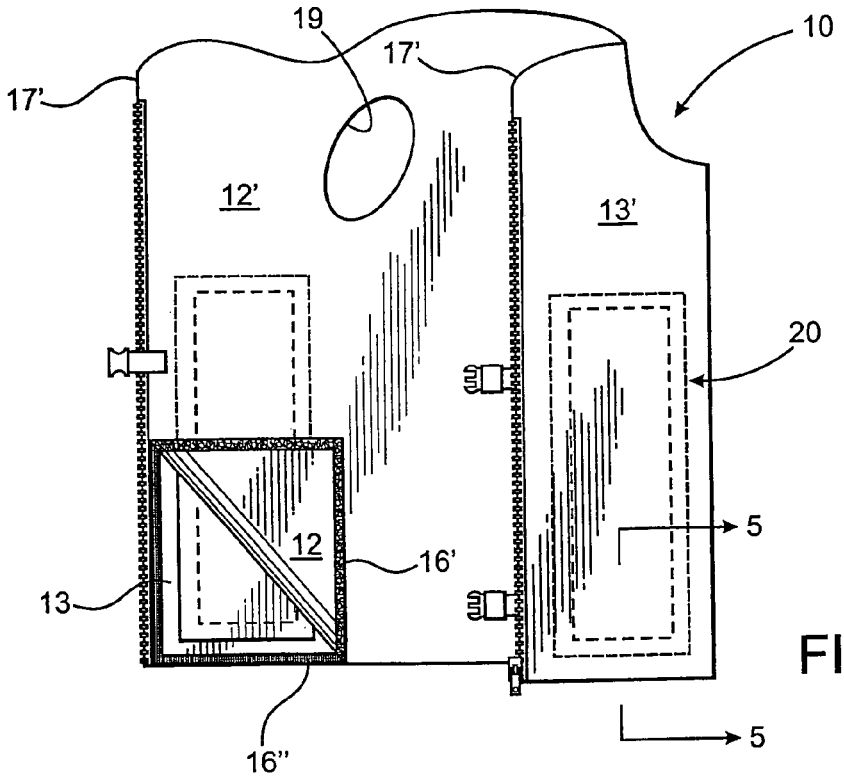
FIG. 3 is front elevation of the embodiment of FIG. 1 illustrating an access mechanism disposed in a partially open position.

As stated above, the present invention is directed to an adjustable combination flotation device, generally as shown at 10 throughout the figures. The flotation device 10 of the present invention includes a support assembly 11 which is structured to be disposed in an operative position about a user. The support assembly 11 comprises an inner panel 12 and an outer panel 13 cooperatively associating with one another and being structured to define and inner surface 12' and an outer surface 13' of the support assembly 11, as illustrated in FIG. 3. Additionally, the inner panel 12 and the outer panel 13 are also structured so as to at least partially define an interior portion 14 and an exterior portion 15 of the support assembly 11. In one preferred embodiment, the inner panel 12 and outer panel 13 are further cooperatively associating with one another to define a pair of apertures 19 structured to permit placement of a user's arms through the support assembly 11 while the support assembly 11 is disposed in an operative position about the user. The inner panel 12 and the outer panel 13 are constructed from any of the materials utilized in the construction of flotation devices including natural fabrics such as canvas, or any one or more of a number of synthetic fabrics, and the panels 12 and 13 are at least partially interconnected to one another along corresponding peripheries using known techniques for attaching such materials including, but not limited to, stitching, adhesives, heat welding, etc.

The outer panel 13 is further structured to at least partially define a front section 17 and a rear section 18 of the support assembly 11. In one embodiment, the front section 17 preferably comprises a pair of opposing edges 17' disposed adjacent one another and which divide the front section 17 into two segments so as to facilitate donning of the flotation device 10 by a user.

Figure 5:
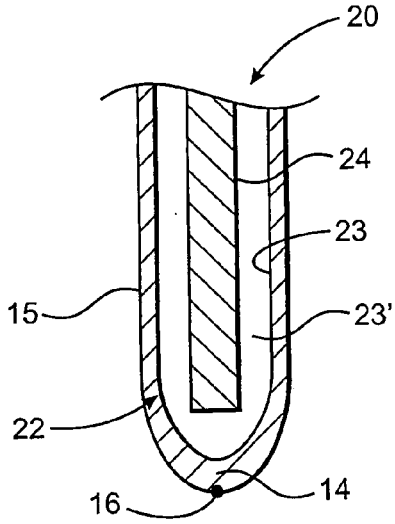
FIG. 5 is a partial cross section of the embodiment of FIG. 3 along lines 5—5 thereof.

In a preferred embodiment, the support assembly 11 of the present invention includes an access mechanism 16 structured to be disposable between an open position, as in FIG. 3, and a closed position, as in FIG. 5. The access mechanism 16 preferably includes a first member 16' interconnected to a portion of the periphery of the inner panel 12 of the support assembly 11 and a second member 16" interconnected to a portion of the periphery of the outer panel 13 of the support assembly 11. As further illustrated in FIG. 3, the access mechanism 16 is preferably disposed along corresponding portions of the peripheries of the inner panel 12 and the outer panel 13 such that the corresponding portions of the peripheries are adjacent one another when the access mechanism 16 is disposed in the closed position. The access mechanism 16 may comprise any one of a number of mechanisms utilized to attach such panels to one another including, by way of example only, a hook and loop type fastener, a sliding fastener, such as a zipper, a plurality of snaps, etc., however, it is understood to be within the scope and intent of the present invention for other types of mechanisms to be utilized to provide access to the interior portion 14 of the support assembly 11, as discussed in further detail below.

As indicated above, the adjustable combination flotation device 10 of the present invention also includes a flotation assembly 20. The flotation assembly 20 of the present invention includes at least one active flotation member 22, however, at least one embodiment of the flotation device 10 may comprise a plurality of active flotation members 22. In one preferred embodiment, at least one active flotation member 22 comprises an inflatable bladder 23 such as are constructed from any one or more of a variety of materials structured to at least temporarily maintain a charge of air or another gaseous component utilized to inflate them. In one further preferred embodiment, the inflatable bladder 23 is constructed of a polyurethane plastic material which is heat sealed about its periphery via a radio frequency heat sealing technique, thereby permitting the inflatable bladder 23 to at least temporarily maintain a charge of air or another gaseous component utilized to inflate the same within an inner portion 23'.

The flotation assembly 20 of the present invention further comprises at least one passive flotation member 24 disposed in an operative engagement with at least one active flotation member 23. As above, with respect to the active flotation members 23, the flotation assembly 20 may comprise a plurality of passive flotation members 24. Further, in at least one embodiment, the passive flotation member 24 comprises a member constructed of a closed cell foam material, for example, a member constructed of the material sold under the brand name Ensolite, as is incorporated in one preferred embodiment of the present invention. More in particular, the passive flotation member 24 is, or the plurality of passive flotation members 24 are, constructed such that in conjunction with all of the remaining components of the adjustable combination flotation assembly 10 of the present invention, the assembly 10 has a minimum buoyancy rating of at least a Type III personal flotation device as designated by the U.S. Coast Guard.

Additionally, the active flotation member 23 is structured and disposed in an operative engagement with the passive flotation member 24, specifically, the passive flotation member 24 being substantially disposed within the inner portion 23' of the inflatable bladder 23, as best illustrated in FIG. 5. More in particular, this operative engagement is structured so as to substantially limit displacement of the flotation members 22 and 24, such as by folding or twisting about one another or themselves, as may otherwise occur while disposed in the interior portion 14 of the support assembly 11, thereby making the flotation device 10 of the present invention more reliable than known flotation devices.

Figure 6:
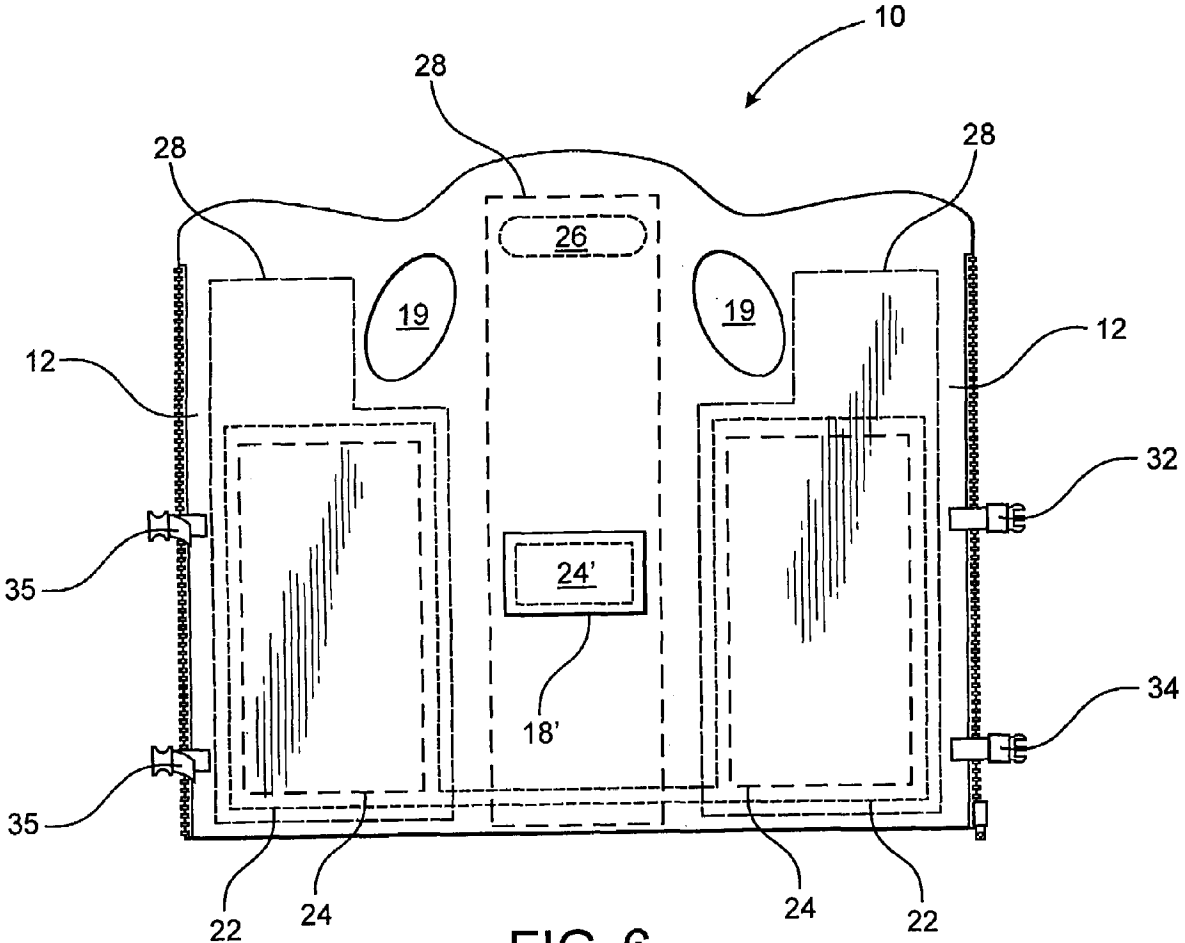
FIG. 6 is an elevation of the embodiment of FIG. 1 illustrating an interior panel.

Further, as noted above, the support assembly 11 of the present invention comprises an access mechanism 16 which allows access to the interior portion 14 of the support assembly 11 as may be required to permit repair and/or adjustment of the flotation assembly 20 disposed therein. For example, access may be required in order to repair a leak in an active flotation member 22, specifically, in an inflatable bladder 23 thereof. In addition, access may be required to add or remove auxiliary passive flotation members 24' which may be added to or removed from the interior portion 14 of the support assembly 11 in order to increase or decrease the overall buoyancy characteristics of the adjustable combination flotation device 10 of the present invention as may be required, respectively. The auxiliary passive flotation members 24' may also comprise a closed cell foam construction, such as Ensolite, as described above, and may be disposed in one or more holders 18' provided, for example, along the rear section 18 in the interior portion 14 of the support assembly 11, as illustrated in FIG. 6.

Figure 2:
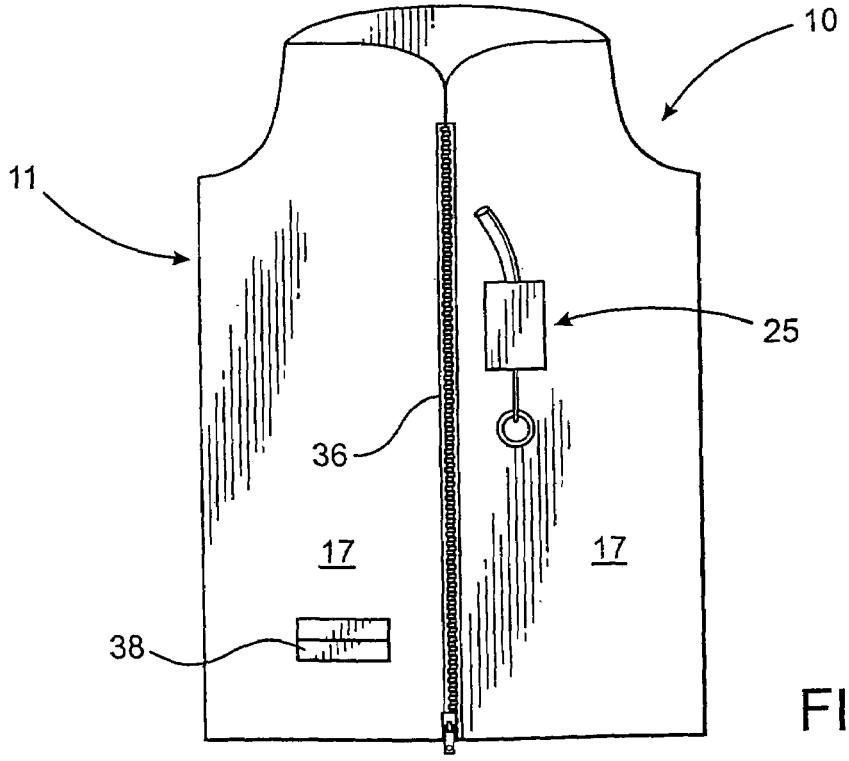
FIG. 2 is a front elevation of the embodiment of FIG. 1 further illustrating a sealing mechanism disposed in a sealing orientation.

The flotation assembly 20 of the present invention also includes an actuation device, generally as shown at 25 throughout the figures, the actuation device 25 being disposed in fluid communication with at least one active flotation member 22. The actuation device 25 may comprise a manual actuator 25', such as a manual inflation tube as shown in FIG. 2. This type of manual actuator 25' allows the user to inflate the active flotation member 22 such that it is disposed in an inflated configuration by simply blowing air into the inner portion 23' of the inflatable bladder 23 through the manual actuator 25'. Typically, such a manual actuation device 25' comprises a one way check valve to prevent air from escaping back therethrough.

One preferred embodiment of the present invention includes an actuation device 25 further comprising a charged actuator 25", also as shown is also shown in FIG. 2. Preferably, the charged actuator 25" comprises a pressurized cartridge of an inert gas such as $CO_2$ or nitrogen, the contents of which may be quickly and readily released into the inner portion 23' of the inflatable bladder 23 by any one of a number of release mechanisms, such as, by way of example only, pulling on the release cable as illustrated in FIG. 2.

In one preferred embodiment, and as previously indicated, the flotation assembly 20 of the present invention comprises a plurality of active flotation members 22, such as are shown in the figures. Additionally, the plurality of active flotation members 22 may be disposed in fluid communication with one another as illustrated, by way of example only, in FIG. 6. In the preferred embodiment illustrated in FIG. 6, a single actuation device 25 is disposed in fluid communication with at least one of the plurality of active flotation members 22. As a result of the fluid communication between the plurality of active flotation members 22, the single actuation device 25 is utilized to inflate each of the plurality of active flotation members 22 into their respective inflated configurations, this process being facilitated by their fluid communication with one another.

The active flotation member 22 is, or the plurality of passive flotation members 24 are, constructed such that in conjunction with all of the remaining components of the adjustable combination flotation assembly 10 of the present invention, the assembly 10 has a minimum buoyancy rating of at least a Type IV personal flotation device as designated by the U.S. Coast Guard, while the active flotation member or members 22 are disposed in their respective inflated configuration(s).

Also as shown in the figures, a preferred embodiment of the present invention comprises a plurality of passive flotation members 24. Once again, and as shown throughout the figures, each of the plurality of active flotation members 22 is preferably structured and disposed in an operative engagement with a corresponding one of the plurality of passive flotation members 24, as best illustrated in FIG. 6. As above, this operative engagement is structured so as to prevent the flotation members 22 and 24 from displacement, such as folding or twisting about one another or themselves, as may otherwise occur within the interior portion 14 of the support assembly 11, thereby eliminating operational and, more importantly, reliability problems which may be associated with such undesirable displacement of the flotation members 22 and 24.

Figure 4:
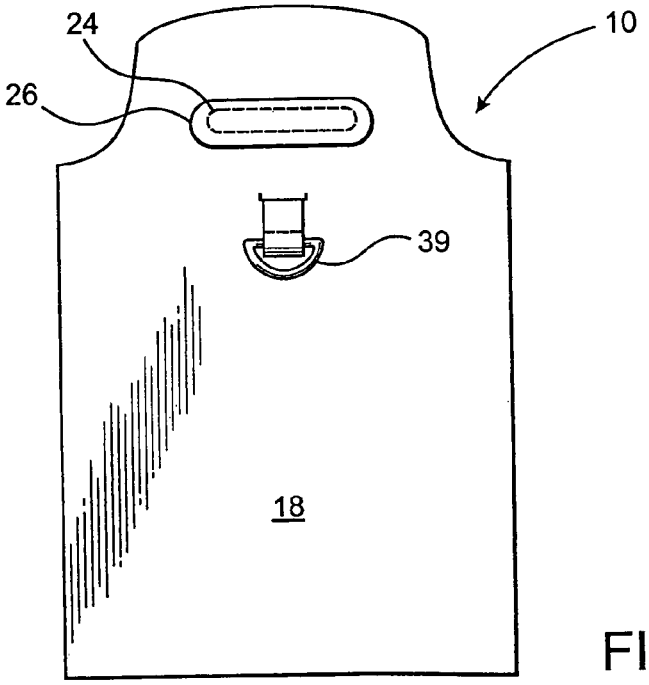
FIG. 4 is a rear elevation of the embodiment of FIG. 1.

In one further preferred embodiment of the adjustable combination flotation device 10 of the present invention the support assembly 11 includes a collar member 26, as illustrated in FIG. 4. The collar member 26 is preferably disposed in an upper portion of the rear section 18 of the support assembly 11, so as to be positioned about the neck region of the user when disposed in an operative position. In a preferred embodiment, the collar member 26 comprises a passive flotation member 24, as illustrated in FIG. 4, constructed of a closed cell foam material, such as Ensolite, as noted above. At least one further embodiment of the collar member 26 comprises an active flotation member 22, such as described above. In this embodiment, the active flotation member 22 of the collar member 26 is disposed in fluid communication with the plurality of active flotation members 22, such that the single actuation device 25 may be utilized to inflate each of the plurality of active flotation members 22, including the active flotation member 22 of the collar member 26.

One further preferred embodiment of the adjustable combination flotation device 10 of the present invention comprises at least one, but preferably a plurality of protective members 28, as illustrated in FIG. 6. The protective members 28 are structured to inhibit penetration of offensive objects, such as bullets, shrapnel, or other projectiles, from penetrating therethrough, in the manner of devices commonly known as "bullet proof vests", so as to protect the user from such offensive objects, and to inhibit damage to the flotation assembly 20, in particular, the inflatable bladders 23. As such, the protective members 28 are constructed of material that possesses such inhibiting properties, such as KEVLAR®, and in one preferred embodiment of the present invention, the protective members 28 are constructed from a light weight material comprising tightly packed, high molecular weight polyethylene fiber, known as SPECTRA®, a preferred fabric for the present invention in view of its strength, light weight, and hydrophobic properties. As previously indicted, the support assembly 11 of the present invention comprises an access mechanism 16 which allows access to the interior portion 14 of the support assembly 11. This access permits the user to add or remove one or more protective members 28 to the interior portion 14 of the support assembly 11 as deemed necessary by the user.

Figure 1:
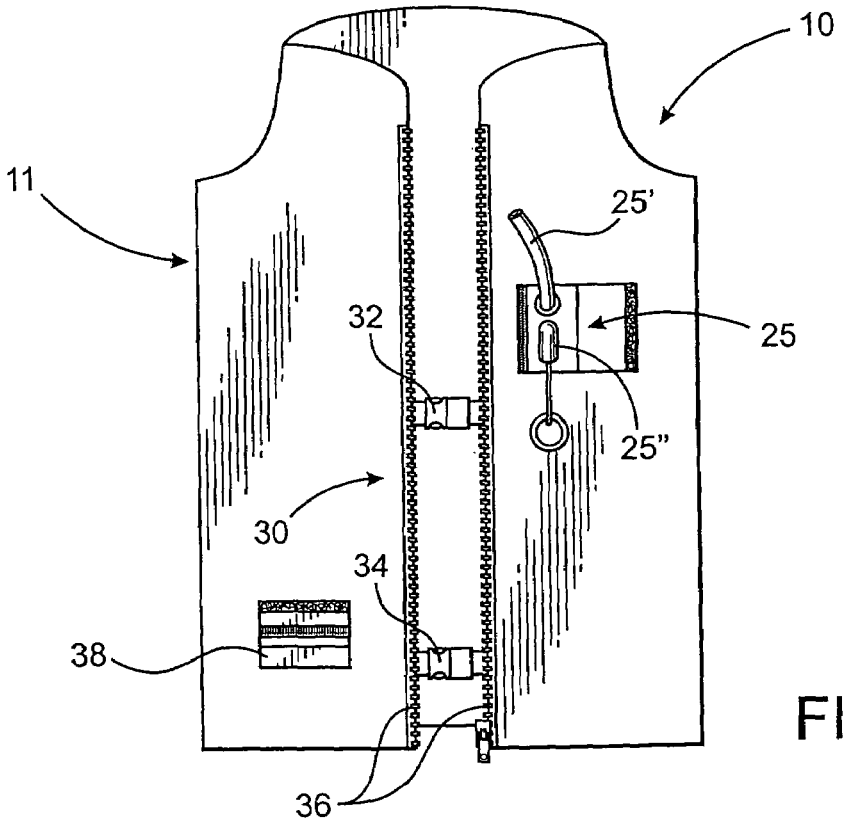
FIG. 1 is a front elevation of one preferred embodiment of an adjustable combination flotation device in accordance with the present invention.

The adjustable combination flotation device 10 of the present invention further comprises an attachment assembly, generally as shown at 30 throughout the figures. Attachment assembly 30 comprises at least one primary attachment mechanism 32 securely interconnected to at least a portion of the inner panel 12 of the support assembly 11. The primary attachment mechanism 32 is structured to be disposable between an attaching configuration, as illustrated in FIG. 1, and a non-attaching configuration, as illustrated in FIGS. 3 and 6. More specifically, and in a preferred embodiment, the primary attachment mechanism 32 comprises a quick release buckle mechanism, a portion of which is securely attached to different portions of the inner panel 12 of the support assembly 11, along the opposing edges 17' thereof, as best illustrated in FIGS. 1 and 6. In addition, this preferred embodiment assures that at least a portion of the primary attachment mechanism 32 is disposed in direct contact with the user's body along the inner surface 12' of the support assembly 11. In one further preferred embodiment, the primary attachment mechanism 32 is disposed such that it is generally located below the user's ribs when the support assembly 11 is disposed in an operative position about the user. Disposing the primary attachment mechanism 32 in this manner along the inner surface 12' in direct contact with the user's body below the ribs assures that the support assembly 11 is securely attached about the user in a fixed configuration substantially limiting displacement of the flotation device 10 relative to the user. More in particular, the primary attachment mechanism 32 prevents the flotation device 10 from "riding up" onto or over the user's head upon impact, for example, upon entry into a body of water. Thus, the attachment assembly 30 of the present invention, and more specifically, the primary attachment mechanism 32, provides a significant advantage over known flotation devices, as previously described.

In at least one embodiment, the attachment assembly 30 of the present invention includes an auxiliary attachment mechanism 34 also structured to facilitate secure attachment of the support assembly 11 about the user in the fixed configuration. The auxiliary attachment mechanism 34 is structured to be disposable between an attaching orientation, as illustrated in FIG. 1, and a non-attaching orientation, as illustrated in FIGS. 3 and 6. In general, the auxiliary attachment mechanism 34 is positioned along a lower portion of the front section 17 of the support assembly 11, as illustrated in the figures, such that it is generally positioned about the user's waist when the support assembly 11 is disposed in an operative position about the user. Preferably, portions of the auxiliary attachment mechanism 34, which may also comprise a quick release buckle mechanism, are also securely attached to different portions of the inner panel 12 of the support assembly 11 adjacent the opposing edges 17' thereof, as shown in FIG. 1. As further illustrated in FIG. 6, both the primary attachment mechanism 32 and the auxiliary attachment mechanism 34 may include an adjustable member 35, such as an adjustable strap, to further facilitate secure attachment of the support assembly 11 in the fixed configuration about the user.

The attachment assembly 30 in one further preferred embodiment additionally comprises a sealing mechanism 36 which is also structured to facilitate secure attachment of the support assembly 11 about the user in the fixed configuration. As best shown in FIGS. 1 and 2, the sealing mechanism 36 is disposed along adjacent and opposing edges 17' of the front section 17 of the support assembly 11. In at least one embodiment, the sealing mechanism 36 comprises a sliding closure mechanism, such as, by way of example only, a zipper, which is structured to further facilitate secure attachment of the support assembly 11 about the user in the fixed configuration. The sealing mechanism 36 also serves to permit ventilation to the user when disposed in a non-sealing orientation as illustrated in FIG. 1. This may be particularly advantageous when a user is required to wear the flotation device 10 for an extended periods of time, such as, for example, during periods of inclement weather while on board a vessel, or in the event of prolonged periods in a body of water.

Figure 7:
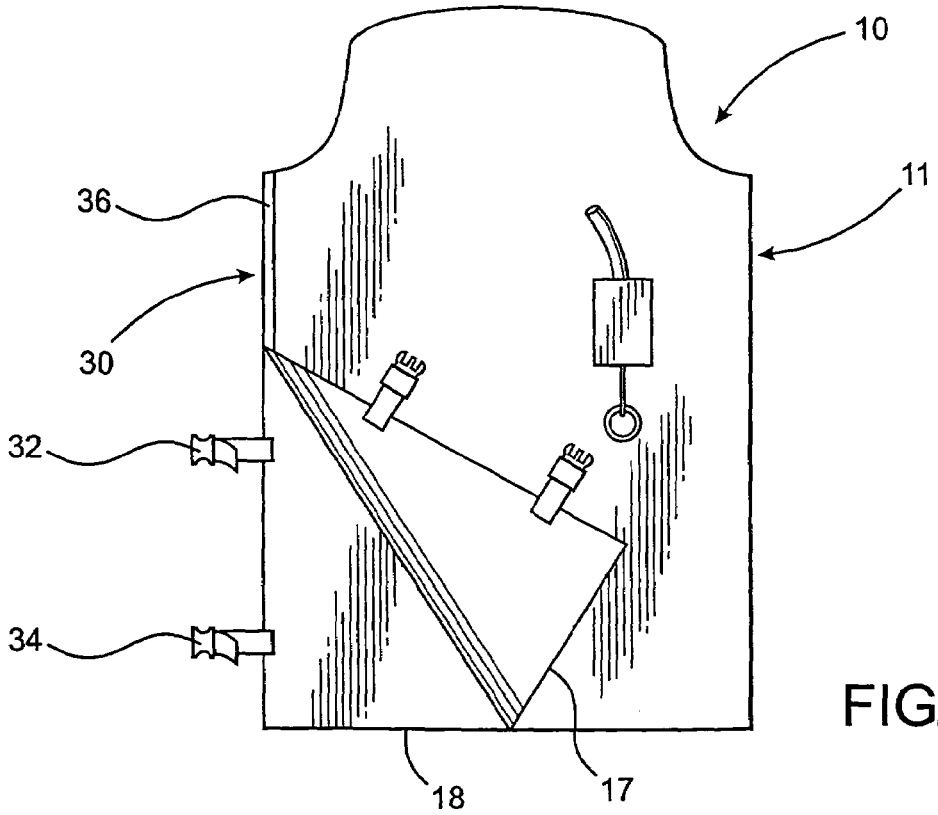
FIG. 7 is a front elevation of one other preferred embodiment of an adjustable combination flotation device in accordance with the present invention, illustrating one alternative embodiment of an attachment assembly.

As shown in FIG. 7, in at least one embodiment, the attachment assembly 30 of the present invention may be disposed along one side of the support assembly 11 adjoining at least a portion of the front section 17 to a portion of the rear section 18. As will be appreciated from the figure, in this embodiment, the device 10 provides substantially complete and uninterrupted coverage of the chest area of the user, such as may be critical in combat application wherein the device is utilized in combination with one or more protective member 28. In this embodiment, the primary attachment mechanism 32 is positioned so as to assure that at least a portion of the primary attachment mechanism 32 is disposed in direct contact with the user's body along the inner surface 12' of the support assembly 11. As above, in one further preferred embodiment, the primary attachment mechanism 32 is disposed such that it is generally located below the user's ribs when the support assembly 11 is disposed in an operative position about the user.

Figure 8:
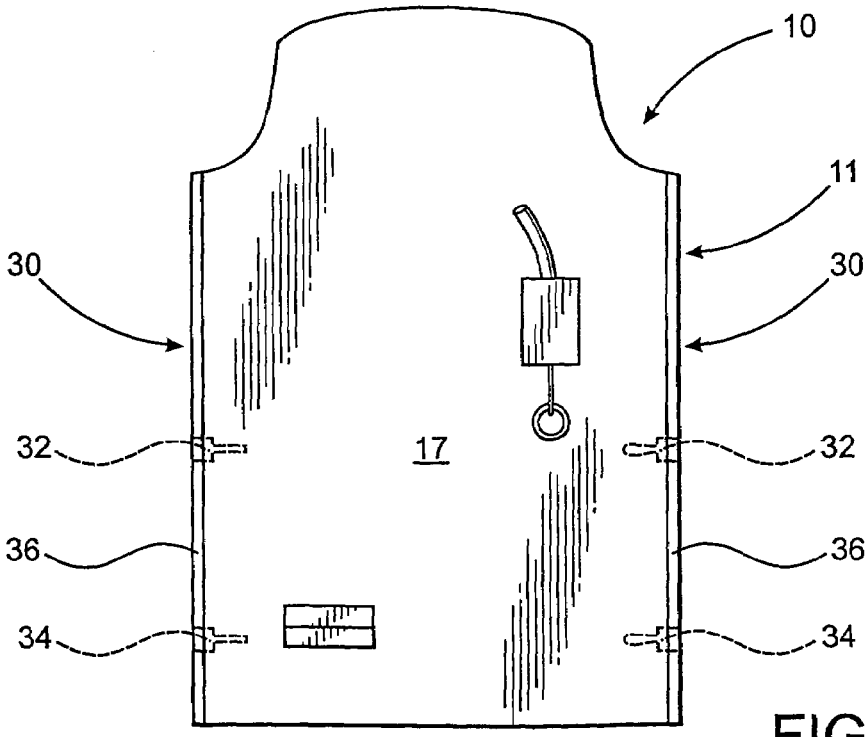
FIG. 8 is a front elevation of another preferred embodiment of an adjustable combination flotation device in accordance with the present invention, illustrating another alternative embodiment of an attachment assembly.

In yet one further embodiment of the adjustable combination flotation device 10 of the present invention, the attachment assembly 30 may be disposed so as to adjoin corresponding portions of the front section 17 and the rear section 18 along both sides of the support assembly 11, as illustrated in FIG. 8. This embodiment provides the advantages of substantially complete and uninterrupted coverage of the chest area of the user, while providing an additional primary support mechanism 32 disposed in direct contact with the user's body along the inner surface 12' of the support assembly 11, as well as an additional auxiliary attachment mechanism 34. The additional primary and auxiliary attachment mechanisms 32 and 34 provide further assurance that the support assembly 11 is securely attached about the user in a fixed configuration and to substantially limit displacement of the flotation device 10 relative to the user, while the support assembly is disposed in an operative position.

In addition to the foregoing, and as illustrated in FIGS. 1 and 2, the adjustable combination flotation device 10 of the present invention may also include at least one storage section 38. The storage section 38 may be utilized to store emergency supplies such as a first aid kit, fresh water, and/or food rations, once again, as may be advantageous to the user in the event of prolonged periods of time in the water or other hazardous environment.

Further, a preferred embodiment of the adjustable combination flotation device 10 of the present invention includes a connection member 39, for example, a D ring, securely attached the support assembly 11. As illustrated in FIG. 4, the connection member 39 may be advantageously attached to an upper portion of the rear section 18 of the support assembly 11. As such, the connection member 39 may be utilized, for example, to permit interconnection of the flotation device 10, and thus, the user, to a safety line, such as maybe desirable while on board a vessel during inclement weather, or to a rescue line to facilitate removal of a user wearing the adjustable combination flotation device 10 of the present invention from the water or other hazardous location.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An adjustable combination flotation device comprising:

a support assembly structured to be disposed in an operative position about a user, said support assembly comprising an inner panel and an outer panel, a flotation assembly disposed in a supported configuration between said inner panel and said outer panel, said flotation assembly comprising at least one active flotation member and at least one passive flotation member disposed in an operative engagement with one another, an attachment assembly securely interconnected to said support assembly and comprising a primary attachment mechanism disposable between an attaching configuration and a non-attaching configuration, said primary attachment mechanism structured to securely attach said support assembly about the user in a fixed configuration substantially limiting displacement of said flotation device relative to the user, and said operative engagement is at least partially defined by said at least one passive flotation member disposed within said active flotation member thereby substantially limiting displacement of said active flotation member and said passive flotation member while disposed in said supported configuration between said inner panel and said outer panel.

2. The device as recited in claim 1 wherein said primary attachment mechanism is securely interconnected to at least a portion of said inner panel of said support assembly and is disposed in direct contact with a portion of the user's body when in said attaching configuration to facilitate secure attachment of said support assembly about the user and to partially define said fixed configuration.

3. The device as recited in claim 1 wherein said attachment assembly further comprises an auxiliary attachment mechanism securely interconnected to said support assembly and disposable between an attaching orientation and a non-attaching orientation, said auxiliary attachment mechanism structured to facilitate secure attachment of said support assembly about the user and to partially define said fixed configuration when disposed in said attaching orientation.

4. The device as recited in claim 3 wherein said auxiliary attachment mechanism is securely interconnected to at least one portion of said inner panel of said support assembly and is disposed in direct contact with a portion of the user's body when in said attaching configuration.

5. The device as recited in claim 3 wherein said auxiliary attachment mechanism comprises at least one adjustable member structured to facilitate secure attachment of said support assembly about the user in said fixed configuration.

6. The device as recited in claim 1 wherein said attachment assembly further comprises a sealing mechanism securely interconnected to said support assembly and disposable between a sealing orientation and a non-sealing orientation, said sealing mechanism structured to facilitate secure attachment of said support assembly about the user and to partially define said fixed configuration when disposed in said sealing orientation.

7. The device as recited in claim 6 wherein said sealing mechanism comprises a sliding closure mechanism.

8. The device as recited in claim 7 wherein said sliding closure mechanism comprises a zipper.

9. The device as recited in claim 1 wherein said primary attachment mechanism comprises at least one adjustable member structured to facilitate secure attachment of said support assembly about the user in said fixed configuration.

10. The device as recited in claim 1 wherein said primary attachment mechanism comprises at least one quick connect buckle.

11. The device as recited in claim 1 further comprising at least one storage section mounted to said outer panel of said support assembly on a front section thereof.

12. The device as recited in claim 1 further comprising a connection member securely mounted to said outer panel of said support assembly on a rear section thereof.

13. An adjustable combination flotation device comprising:

a support assembly structured to be disposed in an operative position about a user, said support assembly comprising an inner panel and an outer panel, said inner panel and said outer panel cooperatively associating to at least partially define an interior portion and an exterior portion of said support assembly, a flotation assembly disposed in a supported configuration substantially within said interior portion, said flotation assembly comprising at least one active flotation member and at least one passive flotation member disposed in an operative engagement with one another, an attachment assembly comprising a primary attachment mechanism securely interconnected to at least one portion of said inner panel and disposable between an attaching configuration and a non-attaching configuration, said primary attachment mechanism structured to securely attach said support assembly about the user in a fixed configuration and in direct contact with a portion of the user's body thereby substantially limiting displacement of said device relative to the user, said support assembly further comprising an access mechanism disposable between an open position and a closed position, at least one protective member structured to inhibit penetration through said device by an offensive object, and said open position is structured to permit placement of said protective member into said interior portion and removal of said protective member from said interior portion.

14. The device as recited in claim 13 wherein said flotation assembly is maintained in said supported configuration substantially within said interior portion while said access mechanism is disposed in said closed position.

15. The device as recited in claim 13 wherein said open position is partially defined by allowing access to said interior portion for adjustment or repair of said flotation assembly disposed therein.

16. The device as recited in claim 13 wherein said protective member comprises a SPECTRA fabric.

17. An adjustable combination flotation device comprising:

a support assembly structured to be disposed in an operative position about a user, said support assembly comprising an inner panel and an outer panel, said inner panel and said outer panel cooperatively associating to at least partially define an interior portion and an exterior portion, said support assembly further comprising an access mechanism disposable between an open position and a closed position, a flotation assembly disposed in a supported configuration substantially within said interior portion of said support assembly, said flotation assembly comprising at least one active flotation member and at least one passive flotation member disposed in an operative engagement with one another, said at least one active flotation member comprising an inflatable bladder, said at least one active flotation member further comprising a polyurethane plastic material being heat sealed with a radio frequency to at least partially define said inflatable bladder, said open position is partially defined by allowing access to said interior portion for adjustment or repair of said flotation assembly disposed therein, an attachment assembly comprising a primary attachment mechanism disposable between an attaching configuration and a non-attaching configuration, and said primary attachment mechanism is securely interconnected to at least a portion of said inner panel of said support assembly and is disposed in direct contact with a portion of the user's body when in said attaching configuration to facilitate secure attachment of said support assembly about the user and to partially define said fixed configuration.

18. The device as recited in claim 17 wherein said operative engagement is at least partially defined by said at least one passive flotation member disposed within said inflatable bladder thereby substantially limiting displacement of said passive flotation member while disposed in said supported configuration between said inner portion of said inflatable bladder.

19. The device as recited in claim 18 wherein said at least one passive flotation member comprises a closed cell foam construction.

20. The device as recited in claim 17 further comprising an actuation assembly structured to inflate said active flotation member.

21. The device as recited in claim 17 wherein said flotation assembly comprises a plurality of active flotation members.

22. The device as recited in claim 21 wherein said plurality of active flotation members are disposed in fluid communication with one another.

23. The device as recited in claim 22 further comprising an actuation assembly structured to inflate said plurality of active flotation members.

24. An adjustable combination flotation device comprising:

a support assembly structured to be disposed in an operative position about a user, said support assembly comprising an interior portion and an exterior portion, said support assembly further comprising an access mechanism disposable between an open position and a closed position, a flotation assembly disposed in a supported configuration in said interior portion of said support assembly, said flotation assembly comprising at least one active flotation member and at least one passive flotation member disposed in an operative engagement with one another, said at least one active flotation member comprising an inflatable bladder, said at least one passive flotation member being disposed within said inflatable bladder substantially eliminating displacement of said passive flotation member within said support assembly, said open position is partially defined by allowing access to said flotation assembly to permit adjustment or repair thereof, said flotation assembly further comprising an actuation assembly structured to inflate said inflatable bladder, an attachment assembly comprising a primary attachment mechanism securely interconnected to at least a portion of an inner panel of said support assembly and disposable between an attaching configuration and a non-attaching configuration, said primary attachment mechanism structured to securely attach said support assembly about the user in a fixed configuration and in direct contact with a portion of the user's body thereby substantially limiting displacement of said device relative to the user, said attachment assembly further comprising an auxiliary attachment mechanism securely interconnected to said support assembly and disposable between an attaching orientation and a non-attaching orientation, said auxiliary attachment mechanism structured to facilitate secure attachment of said support assembly about the user and to further define said fixed configuration when disposed in said attachment orientation, said attachment assembly further comprising a sealing mechanism securely interconnected to said support assembly and disposable between a sealing orientation and a non-sealing orientation, and said sealing mechanism comprising a sliding closure mechanism structured to facilitate secure attachment of said support assembly about the user in said fixed configuration to further limit displacement of said device relative to the user.

25. The device as recited in claim 24 further comprising a collar member.

26. The device as recited in claim 25 wherein said collar member comprises at least one other passive flotation member.

27. The device as recited in claim 25 wherein said collar member comprises at least one other active flotation member.

28. The device as recited in claim 27 wherein said actuation assembly is further structured to inflate said one other active flotation member disposed in said collar member.

* * * * *